US010288258B1

(12) United States Patent
Huang et al.

(10) Patent No.: US 10,288,258 B1
(45) Date of Patent: May 14, 2019

(54) LIGHTING MODULE

(71) Applicants: Shih-Fu Huang, Keelung (TW); Wei-Jung Lee, New Taipei (TW)

(72) Inventors: Shih-Fu Huang, Keelung (TW); Wei-Jung Lee, New Taipei (TW)

( * ) Notice: Subject to any disclaimer, the term of this patent is extended or adjusted under 35 U.S.C. 154(b) by 0 days.

(21) Appl. No.: 15/859,528

(22) Filed: Dec. 31, 2017

(51) Int. Cl.
*F21V 7/00* (2006.01)
*F21V 7/04* (2006.01)

(52) U.S. Cl.
CPC ..... *F21V 7/0041* (2013.01); *F21V 7/0008* (2013.01); *F21V 7/041* (2013.01); *F21V 7/048* (2013.01)

(58) Field of Classification Search
CPC ..... F21V 7/0041; F21V 7/0008; F21V 7/048; F21V 7/041; F21S 41/30; F21S 41/32; F21S 41/321; F21S 41/322; F21S 41/323; F21S 41/33; F21S 41/331–41/338; F21S 41/36–41/37; F21S 7/00; F21S 7/0008; F21S 7/0016; F21S 7/0025; F21S 7/0033; F21S 7/0041; F21S 7/005; F21S 7/0058; F21S 7/0066; F21S 7/0075; F21S 7/0083; F21S 7/0091; F21S 7/04; F21S 7/041; F21S 7/043; F21S 7/045–7/046; F21S 7/048; F21S 7/05–7/10; F21S 7/18; F21S 7/22; F21S 7/24; F21S 7/26; F21S 7/28; F21S 7/30
See application file for complete search history.

(56) References Cited

U.S. PATENT DOCUMENTS

| | | | | |
|---|---|---|---|---|
| 10,006,590 | B2 * | 6/2018 | Koizumi | F21K 9/232 |
| 10,006,604 | B2 * | 6/2018 | Marquardt | F21V 7/0008 |
| 2010/0213835 | A1 * | 8/2010 | Mo | F21V 7/22 313/512 |
| 2011/0182065 | A1 * | 7/2011 | Negley | F21V 5/04 362/231 |
| 2016/0230962 | A1 * | 8/2016 | Yan | G06F 3/0604 |
| 2016/0381749 | A1 * | 12/2016 | Catalano | F21S 10/00 315/297 |
| 2017/0139224 | A1 * | 5/2017 | Fujii | F21V 29/70 |

* cited by examiner

*Primary Examiner* — Joseph L Williams
*Assistant Examiner* — Jose M Diaz

(57) ABSTRACT

The lighting module includes a light emitter, a hood and a cover. The light emitter is mounted on an end of the hood. The cover is disposed in the hood and has a conic reflecting surface. When the light emitter is lit up, the lights are emitted into the hood and reflected by the conic reflecting surface and then further reflected by the hood to be projected outward.

8 Claims, 4 Drawing Sheets

LIGHTING MODULE

BACKGROUND OF THE INVENTION

1. Technical Field

The invention relates to lighting, particularly to LED lighting.

2. Related Art

Three primary colors of light are red, blue and green. In LED (light emitting diode) lighting, white light is formed by mixing red light, blue light and green light. However, lights from a point light source are straight, so evenly mixing lights is hard to obtain and white light from LED lighting appears uneven and impure.

On the other hand, for laser, because of limitation of a resonance chamber to directionality of beam, so a diffusion angle of laser beam is relatively narrow and a laser beam can be projected relatively far. But a laser beam is not suitable for general lighting and light mixing is so difficult.

SUMMARY OF THE INVENTION

An object of the invention is to provide a lighting module, which can evenly mix and diffuse lights from one or more point light sources.

To accomplish the above object, the invention provides a lighting module, which includes a light emitter, a hood and a cover. The hood has a chamber, a light inlet and a light outlet. The light emitter is mounted on the light inlet. The cover is disposed in the chamber and has a main body and a connection portion connected to the main body. The main body corresponds to the light inlet.

DETAILED DESCRIPTION OF THE INVENTION

Figure 1:
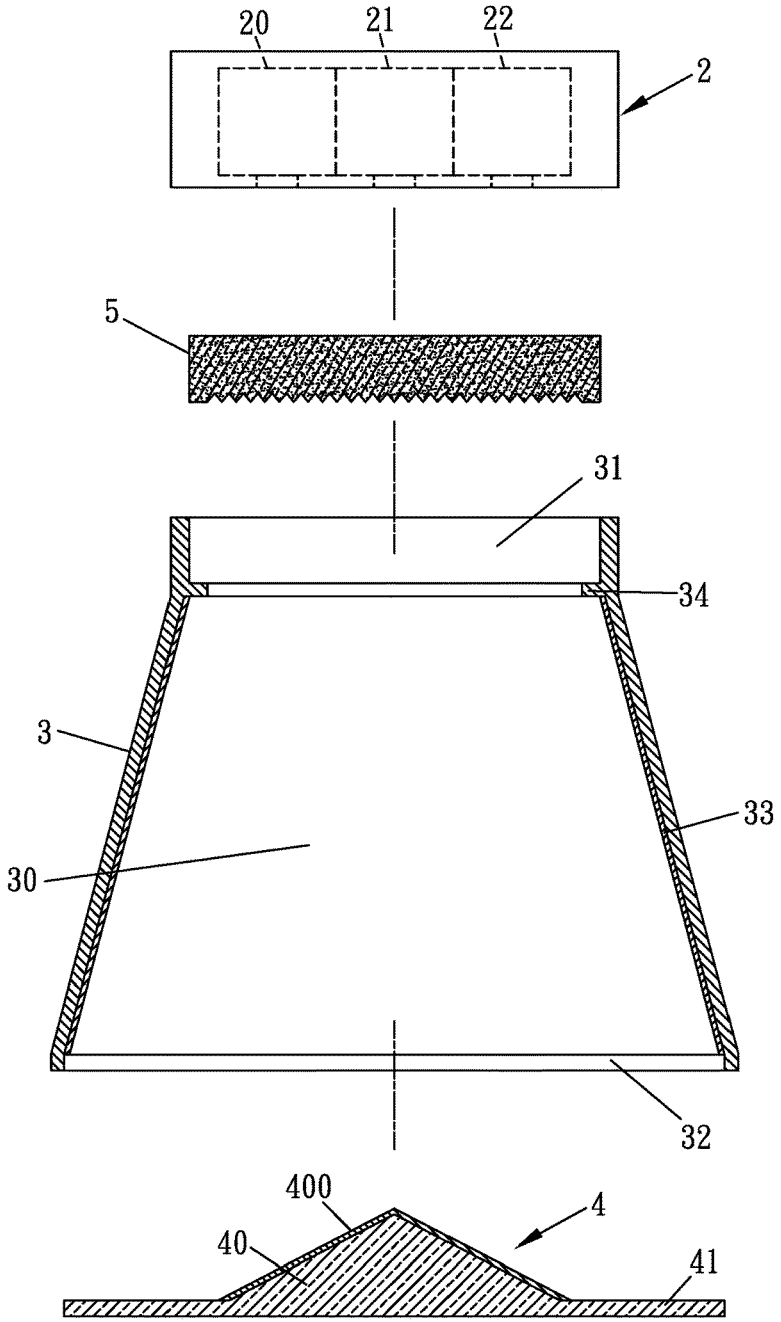
FIG. 1 is an exploded view of the first embodiment of the invention.
Figure 2:
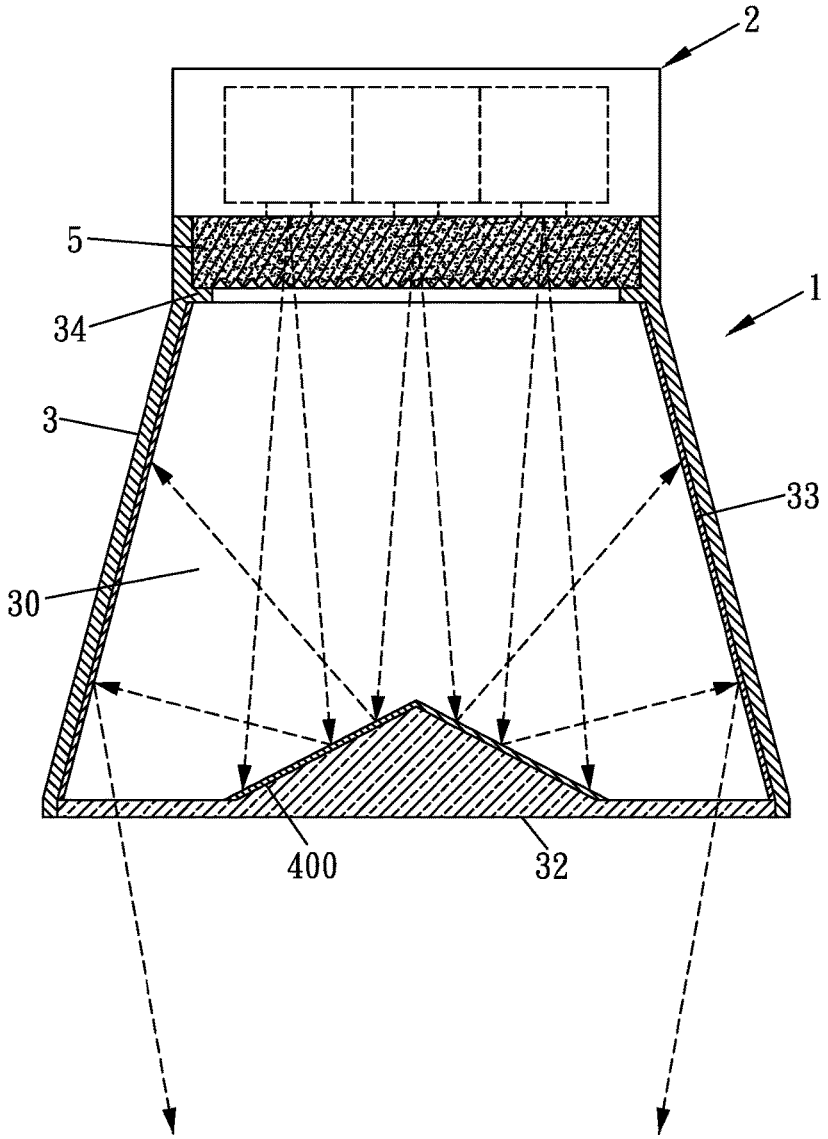
FIG. 2 is an assembled view of the first embodiment of the invention.

FIGS. 1 and 2 show the first embodiment of the invention. The lighting module 1 includes a light emitter 2, a hood 3 and a cover 4. The light emitter 2 is mounted on an end of the hood 3. The cover 4 is fixed onto the other end of the hood 3.

The light emitted 2 may be a single-color point light source or consisted of point light sources with different colors such as red light source 20, blue light source 21 and green light source. These point light sources may be semiconductors such as LEDs (light emitting diodes) or LDs (laser diodes).

There is a chamber 30, a light inlet 31 and a light outlet 32 in the hood 3. A reflection material 33 is disposed on an inner side of the hood 3. The chamber 30, the light inlet 31 and the light outlet 32 communicate with each other. The light emitter 2 is mounted on the light inlet 31. Preferably, the light inlet 31 is formed with a carrier 34 for supporting a light diffuser 5 so as to make the light diffuser 5 located between the light emitter 2 and the chamber 30.

The cover 4 is fixed in the light outlet 32. The cover 4 is made of a light-permeable material and has a main body 40 and a connection portion 41 radially connected to the main body 40. The main body 40 has a conic reflecting surface 400 toward the light emitter 2 or the main body 40 itself is a conic body. The connection portion 41 is light-permeable.

When assembling, as shown in FIG. 2, the light emitter 2 is mounted on the light inlet 31. The cover 4 is fixed onto the light outlet 32 corresponding to the light emitter 2. The lights from the light emitter 2 are diffused by the light diffuser 5 and then projected to the conic reflecting surface 400 so that the lights can be reflected to the reflection material 33 by the conic reflecting surface 400 and finally the lights will pass through the connection portion 41 to project outward. As a result, the lights passing through the connection portion 41 must be reflected at least two times, namely, the conic reflection surface 400 and the reflection material 33. Sufficient softening and/or mixing of lights can be obtained.

Figure 3:
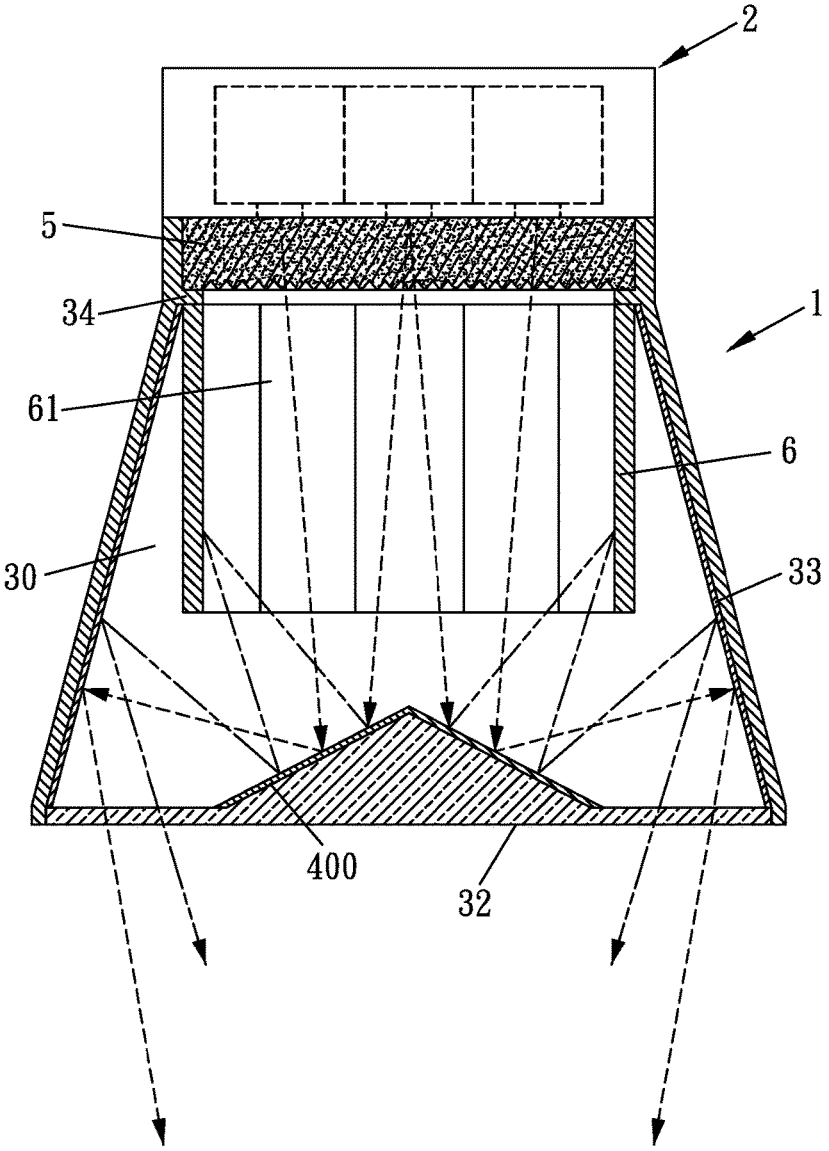
FIG. 3 is an assembled view of the second embodiment of the invention.
Figure 4:
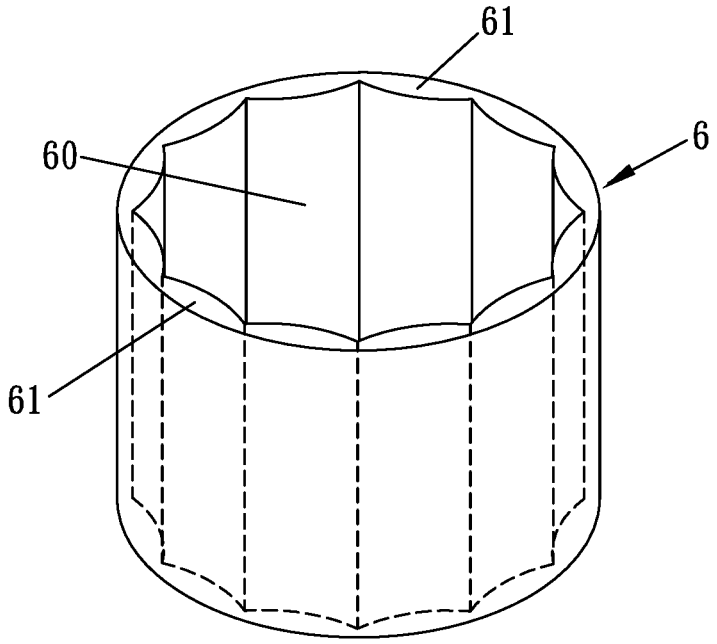
FIG. 4 is a schematic view of light tube of the second embodiment of the invention.

Please refer to FIGS. 3 and 4, which show the second embodiment of the invention. This embodiment further includes a light tube 6 having a channel 60. An inner side of the light tube 6 is formed with a rucked surface 61 formed by a reflection material as shown in FIG. 4. The top end of the light tube 6 is connected onto the carrier 34 so that the light tube 6 is received in the hood 3. The lights from the light emitter 2 are diffused by the light diffuser 5 and then projected to the conic reflecting surface 400 so that the lights can be reflected to both the reflection material 33 and the rucked surface 61 by the conic reflecting surface 400 and finally the lights will pass through the connection portion 41 to project outward.

The lights from the light emitter 2 can be reflected and mixed in the chamber 30 to obtain an even and pure color. Because the light emitter 2 is provided with the hood 3, a light beam divergence angle can be modified by merely changing the shape of the hood 3 to satisfy various requirements.

What is claimed is:

1. A lighting module comprising:

a light emitter;

a hood having a chamber, a light inlet and a light outlet, wherein the chamber, the light inlet and the light outlet communicate with each other, and the light emitter is mounted on the light inlet; and a cover, made of a light-permeable material, disposed in the chamber, having a main body and a connection portion connected to the main body, and the main body having a reflecting surface facing the light emitter;

wherein a light diffuser is disposed between the light emitter and the chamber, and a carrier is formed between the light emitter and the chamber for supporting the light diffuser.

2. The lighting module of claim 1, wherein the reflecting surface is conic in shape.

3. The lighting module of claim 1, wherein the main body is a conic body whose tip is toward the light emitter.

4. The lighting module of claim 1, wherein the light emitter comprises point light sources with different colors.

5. The lighting module of claim 4, wherein point light sources are LEDs (light emitting diodes) or LDs (laser diodes).

6. The lighting module of claim 1, further comprising a light tube, an end of the light tube being connected to the carrier.

7. The lighting module of claim 6, wherein an inner side of the light tube is formed with a rucked reflection surface.

8. The lighting module of claim 1, wherein an inner side of the chamber is provided with a reflection material.

* * * * *